United States Patent [19]

Brucart Puig

[11] Patent Number: 4,996,895

[45] Date of Patent: Mar. 5, 1991

[54] POCKET HAND CORKSCREW

[75] Inventor: Ramón Brucart Puig, Sabadell, Spain

[73] Assignee: Puig Bonich S.A., Sabadell, Spain

[21] Appl. No.: 437,043

[22] Filed: Nov. 15, 1989

[30] Foreign Application Priority Data

Nov. 25, 1988 [ES] Spain ..... 8803507[U]

[51] Int. Cl.[5] ..... B67B 7/44

[52] U.S. Cl. ..... 81/3.09; 81/3.37; 7/154; 7/155

[58] Field of Search ..... 81/3.09, 3.37, 3.29, 81/3.48; 7/154, 155

[56] References Cited

U.S. PATENT DOCUMENTS 984,661 2/1911 Halk ..... 81/3.37
2,512,238 6/1950 Nakamura .
4,574,663 6/1990 Delisle, Jr. ..... 81/3.09

*Primary Examiner*—Frederick R. Schmidt
*Assistant Examiner*—Lawrence Cruz
*Attorney, Agent, or Firm*—Sughrue, Mion, Zinn, Macpeak and Seas

[57] ABSTRACT

The invention provides a pocket hand corkscrew having an operating lever with a bottom and two flanges, attached to a channel-like guideway which may pivot from a position wherein it is applied against the bottom. A slide member may slide along the guideway, is attached to a helical corkscrew member and has teeth. A dog rotatably attached to the lever may engage the teeth when the lever is operated, providing smooth, comfortable movement of the slide member and consequently of the helical screw member previously driven into a stopper.

4 Claims, 2 Drawing Sheets

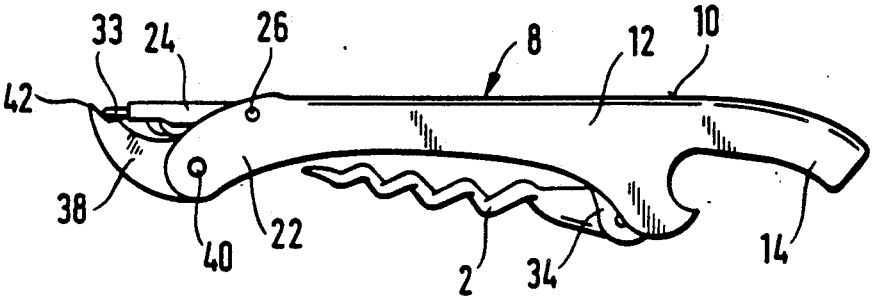
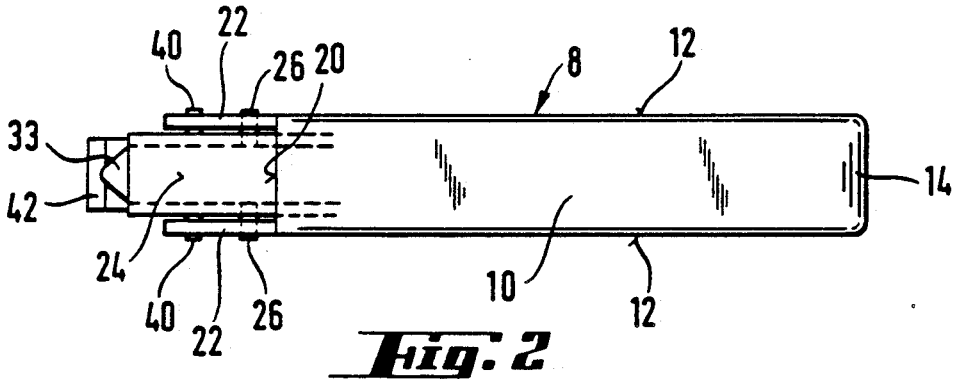
Fig. 2
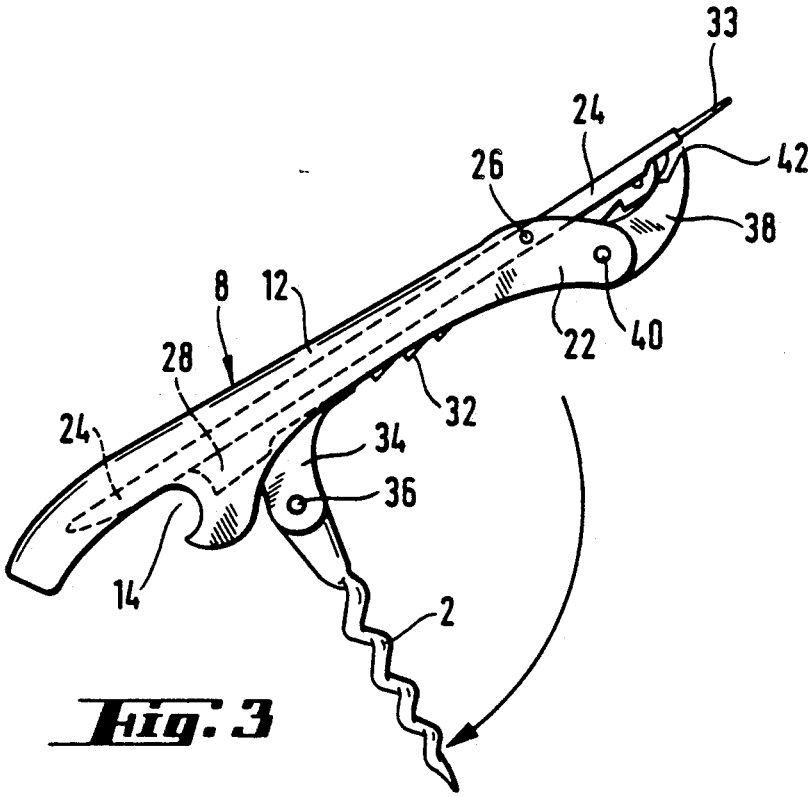
Fig. 3

POCKET HAND CORKSCREW

DESCRIPTION

1. Field of the Invention

The invention relates to a pocket hand corkscrew of the type having a helical screw member and an operating lever having a bottom flanked by two generally parallel flanges.

2. Prior Art

Pocket hand corkscrews are usually used as follows: the screw member is located perpendicular to the operating lever, the lever is pressed to engage the tip of the screw member to the stopper to be removed and is rotated at the same time as pressure is applied, until the screw member has penetrated to a sufficient distance in the stopper.

In the case of certain known corkscrews, the lever is then pulled, which requires a great force, sometimes greater than the user is capable of applying. Frequently said force is not applied axially of the stopper, which easily causes the stopper to break. Furthermore, the brusque cessation of the resistance, when the cork comes fully out, is frequently not accompanied by a simultaneous cessation of the force, which may lead to an undesirable application of said force.

In the case of other corkscrews, the lever is provided with a hinged arm at one end thereof and frequently the hinged arm is shaped for removing crown corks. After penetration of the screw member, the free end of the hinged arm is placed in engagement with the edge of the bottle neck and the lever is pulled in such a way as to rock it around the hinge axis. Thus, the cork follows the movement of the lever, but the fact that this movement follows an arcuate trajectory means that breakage of the cork is also frequent, particularly bearing in mind that the screw member presses the cork against the bottle neck. Also, the fact that crown corks are removed by a hinged arm is also a drawback, since the rotation thereof makes a correct positioning difficult.

SUMMARY OF THE INVENTION

It is an object of the invention to provide a corkscrew with which the foregoing drawbacks are overcome.

This end is achieved according to the invention with a corkscrew of the type first mentioned above, characterised in that it comprises: a channel-like guideway attached to said lever and capable of pivoting between a first position in which it is applied against said bottom and a second angular open position, said guideway having a neb portion; a slide member slidingly housed in said guideway, having a free surface provided with teeth, the slide member being connected to the screw member in such a way as to allow the screw member to rock relative to the slide member in the order of a flat angle; a dog rotatably attached to said lever; and first spring means urging said dog to rotate towards said slide member.

In one development of the invention, one end of the bottom of said lever has a terminal end while said flanges form extensions extending beyond said edge and the channel-like guideway is attached to the operating lever by way of first axial means located on said flange extensions and spaced a short distance from said terminal end and generally flush with the bottom of the lever, while the dog is attached to said lever by second axial means situated on said flange extensions spaced a greater distance apart from said terminal end than said short distance and at a different level than said bottom.

BRIEF DESCRIPTION OF THE DRAWINGS

Further advantages and features of the invention will be appreciated from the following description in which a preferred embodiment of the invention is described, without any limitation and with reference to the accompanying drawings, in which:

FIG. 1 is a side elevation view of the corkscrew of the invention, in the closed position thereof, namely in the out-of-use position.

FIG. 2 is a plan view of the corkscrew in the position of FIG. 1.

FIG. 3 is a side elevation view of the corkscrew of the invention with the channel-like guideway applied against the bottom of the operating lever, with the helical screw member perpendicular to the slide member and the latter slightly moved relative to the channel-like guideway.

DETAILED DESCRIPTION OF A PREFERRED EMBODIMENT

Figure 6:
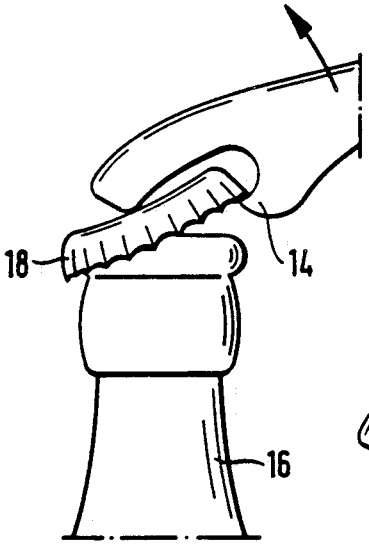
FIG. 6 is a partial view of the corkscrew in position for removing a crown cork.

The corkscrew is provided with a helical screw member 2, known per se, the pointed tip of which allows it to penetrate in the cork 4 to be removed from the bottle 6. The operating lever 8, also in a known way, may be held in the hand to impress the necessary rotary movement to the screw member 2 to be inserted in the cork 4. The lever 8 is formed generally by a channel-shaped member which comprises a bottom 10 flanked by generally parallel flanges 12. At one end 14, said flanges are hook-shaped, making them suitable (FIG. 6) for opening bottles 16 having a crown cork 18. In this sense, it should be noted that the end 14 has no movement relative to the lever 8, thereby facilitating the removal of crown corks. At the opposite end to end 14, the bottom 10 is terminated in a terminal edge 20. In turn, the flanges 12 form extensions 22 extending beyond the edge 20, away from the end 14.

Figure 4:
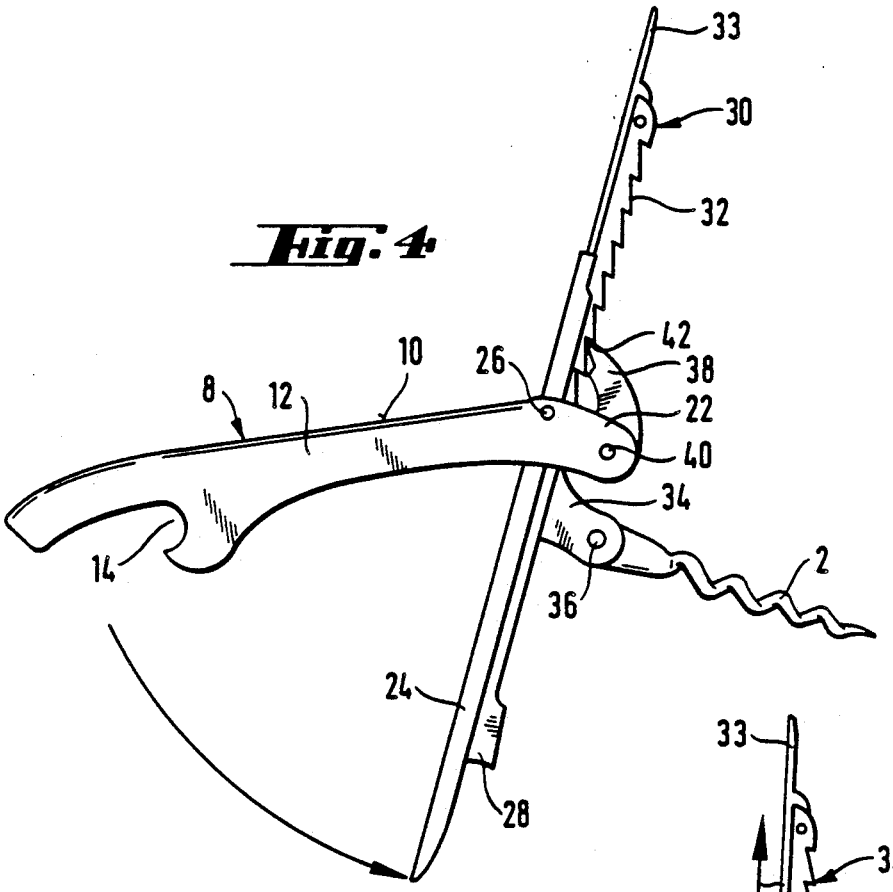
FIG. 4 is a similar view to FIG. 2, with the channel-like guideway angularly opened relative to the lever and the slide member moved relative to the guideway.
Figure 5:
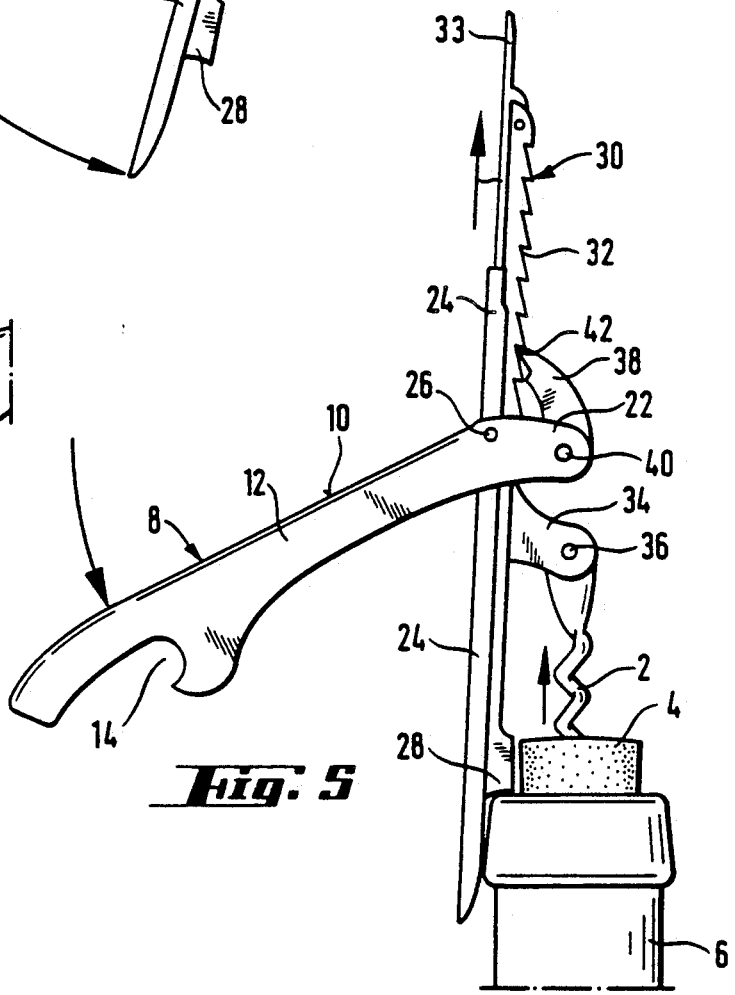
FIG. 5 is an elevation view of the corkscrew in position to draw a cork from a bottle, shown only in part.

The corkscrew comprises a channel-like guideway 24 which is pivotably connected to the lever 8; the guideway may pivot between a first position (FIGS. 1 to 3) where it bears against the bottom 10 and an angularly open position (FIGS. 4 and 5). When applied against the bottom, it bears obviously against the inner surface of the bottom 10 but, in view of the existence of the terminal edge 20, the contact is partial, and it may be said that the part of the channel-like guideway which does not bear against the bottom 10 is generally aligned therewith; further mention will be made of the angularly open position hereafter. The lever 8 is preferably connected to the guideway 24 by first axial means 26, which may be formed by a pin or like members. The axial means 26 is located in the extensions 22 of the flanges 12 a short distance from the terminal edge 20 and generally flush with the bottom 10. Furthermore, the guideway 24 is also provided with a neb portion 28 to be mentioned hereafter.

A slide member 30 is unremoveably housed in the channel of the guideway, for example by way of appropriate folds. Nevertheless, the relationship between the guideway 24 and the slide member 30 allows the slide member to slide along the guideway 24. The slide member is provided with a free surface having teeth 32 which have a first gently sloping flank and a second sharply sloping flank. The end thereof is provided with an arcuate cutting portion terminating in a tip 33 wherewith the capsules surrounding bottle necks may easily be cut. The advantage should be noted here of not having to open out the cutting member, as happens with the conventional corkscrews. There is also a fork 34 (or like arrangement) fixedly attached to the slide member 30 and which has a cross pin 36 or the like, allowing connection with the helical screw member, such that this joint allows the screw member 2 to rock relative to the slide member in an angle of practically 180°. The fork 34 will be seen to prevent excessive sliding of the slide member.

There are preferably second spring means alternatively urging the screw member 2 to a generally perpendicular position relative to the slide member (FIGS. 3 and 4) or to a first folded down position on the slide member towards the tip 33 thereof (FIG. 1) or to a second fold down position generally opposite to the previous position (FIG. 5). The second spring means usually prevents the screw member 2 from remaining in a position intermediate the above mentioned positions. The lever 8 is also attached to a dog 38. The latter is rotatably attached, preferably by means of second axial means 40 (such as a pin or like members) located in the extensions 22, such that the spacing therefrom to the terminal edge 20 is greater that the spacing between the first axial means 26 and the edge 20. Furthermore, the second axial means 40 are situated at a level different from the level of the bottom 10. First spring means urge said dog 38 towards said slide member so that the tip 42 thereof engages the slide member. It should be noted, in particular, that when the slide member 30 is not slid relative to the channel-like guideway 24, the dog 38 is disposed in front of the tip 33, preventing the slide member 30 from sliding.

The operation of the corkscrew is described hereafter. Starting out from the position shown in FIG. 1, the helical screw member 2 is pivoted into the perpendicular position. This pivoting may be accompanied (after lifting the dog 38) by a short sliding movement of the slide member 30 (FIG. 2), whereby the screw member 2 is better centered relative to the operating lever 8.

In this position, as is usual with the known corkscrews, the screw member 2 is applied against the bottle stopper to be removed and is caused to rotate until it has penetrated sufficiently. Thereafter, the screw member 2 and slide member 30 are caused to move relatively to each other until the second fold down position of the screw member 2 is reached and so that at the same time the projection 28 engages the top edge of the bottle 6.

In this position, the lever 8 is disposed like a first class lever, with the fulcrum in the first axial means 26. When the lever is raised in the position of FIG. 5, the dog 38 drops, so that the tip thereof slides along the first gently sloping flank of a tooth 32. When the lever is moved in the opposite direction, the tip of dog 38 engages the second flank of a tooth 32, whereby the downward movement of the lever is accompanied by a raising of the dog, causing the slide member 30, the screw member and, consequently, the cork 4 to rise. When these movements are repeated several times, the stopper is pulled out and in view of the magnitudes of the power arm and of the weight arm of the lever 8, the stopper is removed with a gentle, easy to apply force.

What I claim is:

1. A pocket hand corkscrew of the type having a helical screw member (2) and an operating lever (8) having a bottom (10) flanked by two generally parallel flanges (12), comprising: an elongate guideway (24) having a channel-like cross-section, said guideway being attached to said lever and capable of pivoting between a first, closed position in which said guideway rests against said bottom and a second angular open position, said guideway having a neb portion (28); a slide member (30) slidingly housed in said guideway, and having a free surface provided with teeth (32), the slide member being connected to said screw member in such a way as to allow the screw member to pivot relative to the slide member through an angle of approximately 180°; and a dog (38) rotatably attached to said lever such that said dog tends to remain rotated towards said slide member.

2. The corkscrew of claim 1, wherein one end of the bottom of said lever has a terminal edge (20) while said flanges form extensions (22) extending beyond said edge and the guideway is attached to the operating lever by first axial means (26) located on said flange extensions and spaced a short distance from said terminal edge and generally flush with the bottom of the lever, said dog being attached to said lever by second axial means (40) situated on said flange extensions and spaced a greater distance from said terminal edge than said short distance and at a different level than said bottom.

3. The corkscrew of claims 1 or 2, wherein said slide member has an arcuate cutting tip at one end thereof.

4. The corkscrew of claims 1 or 2, wherein said flanges are hook-shaped and are adapted to open crown caps.

* * * * *